US006347904B1

(12) United States Patent
Knighton

(10) Patent No.: US 6,347,904 B1
(45) Date of Patent: Feb. 19, 2002

(54) FLY CLAMP FOR REINFORCING BARS IN CONCRETE CONSTRUCTION

(76) Inventor: George Stuart Knighton, P.O. Box 383, Alexis, NC (US) 28006

( * ) Notice: Subject to any disclaimer, the term of this patent is extended or adjusted under 35 U.S.C. 154(b) by 0 days.

(21) Appl. No.: 09/718,965

(22) Filed: Nov. 22, 2000

Related U.S. Application Data

(63) Continuation of application No. 09/371,473, filed on Aug. 10, 1999, which is a continuation of application No. 09/059,594, filed on Apr. 14, 1998, now abandoned.

(51) Int. Cl.[7] ..... F16B 7/04; F16B 2/08; E04C 5/16; F16L 3/08

(52) U.S. Cl. ..... 403/400; 403/398; 403/385; 52/719; 52/583.1; 52/587.1; 248/65

(58) Field of Search ..... 403/400, 385, 403/398, 394, 396, 213; 52/719, 583.1, 587.1; 248/65

(56) References Cited

U.S. PATENT DOCUMENTS

| | | | | |
|---|---|---|---|---|
| 977,704 A | * | 12/1910 | Brownlee | 52/719 |
| 1,646,587 A | * | 10/1927 | Lunsford | 403/121 X |
| 1,781,458 A | * | 11/1930 | Gore | 403/400 |
| 2,894,773 A | | 7/1959 | Noe | |
| 3,243,151 A | | 3/1966 | Varney et al. | |
| 3,591,163 A | | 7/1971 | Anderson | |
| 4,148,456 A | | 4/1979 | Garchinsky | |
| 4,492,507 A | * | 1/1985 | Landoll et al. | 414/475 |
| 4,719,672 A | | 1/1988 | Apperson et al. | |
| 4,732,371 A | * | 3/1988 | Pflederer | 267/52 |
| 4,974,381 A | * | 12/1990 | Marks | 52/309.12 |
| 4,998,691 A | | 3/1991 | Brown | |
| 5,111,770 A | * | 5/1992 | Weelink | 403/390 X |
| 5,274,888 A | | 1/1994 | Payne | |
| 5,468,092 A | | 11/1995 | Saunders | |
| 5,823,147 A | | 10/1998 | Hitchcock, Jr. | |
| 5,878,546 A | * | 3/1999 | Westover | 52/719 |
| 5,961,248 A | * | 10/1999 | Tourtellotte | 403/400 |
| 5,971,654 A | | 10/1999 | Sweeney, Jr. | |
| 6,009,680 A | * | 1/2000 | Mathews | 52/719 |
| 6,227,757 B1 | * | 5/2001 | Delouvee et al. | 403/400 |

FOREIGN PATENT DOCUMENTS

| | | | |
|---|---|---|---|
| AU | 100731 | | 4/1937 |
| BE | 495157 | | 8/1950 |
| FR | 1297819 | | 5/1961 |
| FR | 1337147 | | 7/1963 |
| GB | 636068 A | * | 4/1950 |
| GB | 2241735 A | | 9/1991 |

* cited by examiner

*Primary Examiner*—Lynne H. Browne
*Assistant Examiner*—Ernesto Garcia
(74) *Attorney, Agent, or Firm*—Summa & Allan, P.A.

(57) ABSTRACT

A method and apparatus are disclosed for use in conjunction with concrete construction that incorporates steel reinforcing bar formwork. In particular, the invention relates to a clamp that includes a plate having a plurality of gripping positions for clamping a first reinforcing bar against the plate and a recessed channel positioned on the plate between the gripping positions so that when a second reinforcing bar is aligned in the channel and the first reinforcing bar is clamped at the gripping position, the gripping positions will hold the first reinforcing bar and will also hold the first reinforcing bar in an overlying fashion against the second reinforcing bar in the channel. The present method includes constructing formwork from reinforcing bar for use in concrete construction, and in particular, includes the steps of assembling reinforcing bars into a desired arrangement, stabilizing the formwork by securing clamps to select intersections, and lifting the assembled formwork for incorporation into a building under construction.

29 Claims, 3 Drawing Sheets

FLY CLAMP FOR REINFORCING BARS IN CONCRETE CONSTRUCTION

CROSS-REFERENCE TO RELATED APPLICATION

This application is a continuation of co-pending U.S. application Ser. No. 09/371,473, filed Aug. 10, 1999, which is a continuation of U.S. application Ser. No. 09/059,594, filed Apr. 14, 1998 now abandoned.

FIELD OF THE INVENTION

The invention relates to a method and apparatus for use in steel reinforced concrete construction. In particular, the invention relates to a clamp for reinforcing a plurality of reinforcing bars assembled into formwork for use in steel reinforced concrete construction.

BACKGROUND OF THE INVENTION

One of the most prevalent articles used to reinforce concrete structures is a steel reinforcing bar, commonly abbreviated and referred to as "rebar." Rebar is useful in constructing a variety of residential and commercial structures to include buildings, foundations for buildings, high-rise hotels, driveways, residential home slabs, dams, parking garages, retaining walls, bridges, and sidewalks. Specifically, rebar is used to reinforce concrete structures exposed to heavy tensile, compressive, and shear stresses. Operators generally require rebar that is ductile and resilient because rebar is generally bent and shaped to conform to a desired structural form. Accordingly, rebar is manufactured by a mill heat treatment process that imparts these desired traits. Further, rebar is routinely galvanized (i.e., coated with rust resistant zinc) prior to incorporation into a structure in order to improve its resistivity to corrosion and to minimize the environmental factors affecting the durability of the rebar (e.g., temperature extremes).

Conventional rebar is milled into cylindrical rods optionally including a number of longitudinal ribs and crescent shaped ribs forming a helical pattern (i.e., threaded or spiral pattern) extending the length of the bar and transverse to the longitudinal ribs. The longitudinal ribs and crescent shaped ribs are generally of uniform height. The transverse ribs are also inclined at a desired angle relative to the longitudinal axis of the rebar. The helical ribs formed on the exterior of rebar are capable of engaging a variety of devices used to secure or strengthen the structure (e.g., correspondingly threaded nut or flexible tie wire). In addition, characteristic markings consisting of small longitudinal or inclined ribs spaced at varying intervals along the rebar are used to enable construction workers to identify particular workpieces assembled from rebar.

The type of reinforcing technique used in concrete construction depends upon the forces to which the structure will be exposed. For example, reinforcing steel mesh is often suitable for low stress applications such as a small retaining wall along an embankment. Further, the flexibility of the steel mesh allows operators to incorporate the mesh into a shaped structure in a relatively easy fashion. In other words, reinforcing steel mesh is easily cut and shaped to conform to a structure. In contrast, structures exposed to high tensile and compressive forces require a set of rigid forms or pieces (e.g., rebar) of sufficient strength to reinforce concrete forms such as walls or floors. As is known to those familiar with reinforced concrete construction, the set of forms used in constructing concrete reinforced structures is known as formwork. The formwork resembles a grid-like pattern forming the shell (or superstructure) of a building constructed of steel reinforced concrete. Rebar formwork is generally visible during the construction of high-rise buildings. The limited amount of square footage in heavily populated cities demands that engineers construct highrise office buildings and multi-level parking decks of rebar formwork. The incorporation of rebar into these structures occurs at nearly every stage of construction.

For example, large high-rise buildings require solid foundational supports formed of piers (i.e., vertical support structure). The piers are formed by drilling circular shafts into the ground, constructing a circular cage of rebar by entwining rods of rebar in a spiral fashion around vertically extending rods of rebar, positioning the circular cage of rebar in the drilled shafts, and then filling the shafts with wet concrete. The concrete eventually sets and engineers are then able to proceed with construction by incorporating rebar formwork in the structure in an upward direction. Examples of rebar cages used in drilled shafts include drilled piers, caissons, cast-in-drilled-hole piling, and cast-in-place piles.

As described previously, rebar formwork is also used in the construction of vertical walls and foundation slabs. A conventional method for incorporating rebar formwork into concrete construction to form a vertical structure (e.g., wall) includes securing one end of a set of parallel, vertically extending reinforcing bars to the foundation of a structure and thereafter securing a set of parallel, horizontally extending reinforcing bars perpendicular to the vertically extending reinforcing bars. The resulting lattice arrangement (i.e., the formwork) is subsequently encased by a forming system that includes steel rails, cross members, and steel or wood panels, such as the forming systems sold under the trademark STEEL-PLY® and VERSIFORM®. Thereafter, concrete is poured into the encasement and around the formwork. Once the concrete sets, the components of the forming system (i.e., rails and panels) are removed, thus revealing a steel reinforced concrete vertical wall. The process of encasing formwork and pouring concrete continues in an upward fashion until a desired height is reached.

Similarly, formwork can be assembled on a flat surface adjacent the construction site and then lifted to a desired section of the building under construction. This method includes arranging a series of parallel reinforcing bars on the ground near the construction site and then overlaying another series of parallel reinforcing bars on top of and perpendicular to the previously arranged reinforcing bars. Intersections formed by the intersecting portions of overlapping reinforcing bar are then tied together by strapping material or wire. Typically, those assembling the formwork out of rebar must determine the length of reinforcing bar required for the specific job (e.g., retaining wall or building siding), cut the pieces of rebar into the required lengths, and then bind the individual pieces of rebar into a desired arrangement. The formwork is then lifted by a crane or other conventional lifting means to a desired height (e.g., to an upper-level of a multi-level building). Unfortunately, the lifting of the formwork places stress upon the intersections of the reinforcing bar. Thus, many construction workers opt to weld a number of the intersections of reinforcing bar in order to ensure that the formwork assembly retains its arrangement during lifting. The welding step, in particular, is time consuming and requires a trained welder. Further, the welding process results in overall downtime during the construction process.

Upon reaching the desired height, the formwork is lashed or tied to the building's superstructure and the formwork is encased by steel rails, cross-members, and panels of the above-referenced forming system. Concrete is then poured into the encasement form and around the rebar formwork, resulting in a steel reinforced concrete vertical wall once the concrete sets and the encasement form is removed.

Rebar may also be used to construct a concrete foundation or sidewalk in a similar manner by arranging a series of parallel reinforcing bars on the foundation of the slab or sidewalk to be constructed and then overlaying another series of reinforcing bars on top of and perpendicular to the previously arranged reinforcing bars. Thereafter, the rebar is tied together at their intersections and concrete is poured onto the rebar formwork. This method is used to form, for example, the foundation of a single story structure as well as an intermediate foundation of a multi-story building that serves as both the floor and roof of adjoining levels.

Advantageously, rebar can be recycled by stripping the surrounding concrete from the outer surface of the rebar. Thereafter, the rebar can be remilled and then incorporated into a different structure.

Nevertheless, the conventional methods described above fail to provide sufficient support to the rebar formwork when the formwork is lifted or transported from the assembly site to the construction site. In particular, the conventional method of lifting the assembled formwork secured by wire pieces directs an inordinate amount of stress to the wire bound intersections of reinforcing bar. In other words, the stress placed on the piece of rebar that is connected to the crane is directed to the wires binding the adjacent intersections. The wires tend to snap under the concentrated stress in a cascading fashion along the length of the formwork. Accordingly, the falling pieces of rebar destroy the structural integrity of the formwork. Further, individual pieces of rebar or sections of bound rebar falling from the raised formwork may damage the superstructure and cause bodily harm to any construction workers who may be in the path of the falling debris. Further, the remaining rebar is often bent beyond repair and has to be discarded.

Therefore, there is a need for a means for stabilizing the reinforcing bars assembled into formwork for use in steel reinforced concrete construction.

Therefore, there is also a need for a means for reinforcing formwork for use in steel reinforced concrete construction so that the formwork retains its structural integrity during transportation.

Further still, there is a need for a method for constructing formwork for use in steel reinforced concrete construction whereby the formwork maintains its structural integrity when the formwork is transported from an assembly site to a construction site.

OBJECT AND SUMMARY OF THE INVENTION

The invention meets these objectives with a device for fixing reinforcing bar formwork in a desired configuration such that the configured formwork maintains its structural integrity when the formwork is lifted. In particular, the device is a clamp that secures two overlying reinforcing bars at an angle to one another at the intersection of the two bars. The clamp includes a plate with at least two gripping positions on opposite sides of the intersection of the reinforcing bars that grips one reinforcing bar between another reinforcing bar and the plate. A recessed channel on one face of the plate cradles the reinforcing bar sandwiched between the plate and the other reinforcing bar. The gripping positions on opposite sides of the intersection of the reinforcing bar distribute the majority of the weight of the formwork from the intersection to the plate, thus reducing the load bearing forces acting on the intersection of the reinforcing bar when the formwork is lifted. Advantageously, the reduction of force acting on the intersection reduces the likelihood that the formwork will bend or break.

Another goal of the present invention is to develop a method of constructing formwork for used in concrete construction wherein reinforcing bar is arranged in a desired assembly and reinforced by clamping the bars together with the present invention at selected intersections and then lifting the reinforced formwork to a desired location.

In sum, the advantages of the present invention mentioned above eliminate the multiple steps discussed in the conventional methods (i.e., cutting and welding of rebar) and therefore increase efficiency of the entire process.

The foregoing and other objects and advantages of the invention and the manner in which the same are accomplished will become clearer based on the following detailed description taken in conjunction with the accompanying drawings in which:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed is limited to the embodiment set forth herein; rather, these embodiments are provided so that this disclosure will be thorough and complete, and will fully convey the scope of invention to those skilled in the art. Like numbers refer to like elements throughout.

Therefore, it is an object of the invention to provide a device that allows construction workers to quickly arrange and secure reinforcing bars into formwork for use in concrete construction. The device stabilizes the formwork in the desired assembly so that the formwork retains its structural shape when the formwork is lifted and transported to a desired location. In short, the present invention allows the worker to rapidly situate the reinforcing bar on the ground or any relatively flat surface in a desired assembly, optionally fasten selected intersections of the reinforcing bar together with wire pieces, and then affix the device to select intersections (e.g., intersections not previously fastened). It is another object of the invention to provide a device that reinforces the formwork such that the desired assembly remains intact when the formwork is lifted from the assembly site to the construction site. It is a further object of the invention to provide a device that disperses the stress placed on the intersections caused by lifting the formwork to areas besides the point of contact between the intersecting bars. It is a yet another object of the invention to provide a method for rapidly assembling reinforcing bar into formwork and thereafter safely moving the reinforced formwork from the assembly site to a desired construction site wall while maintaining the structural integrity of the same formwork.

Figure 1:
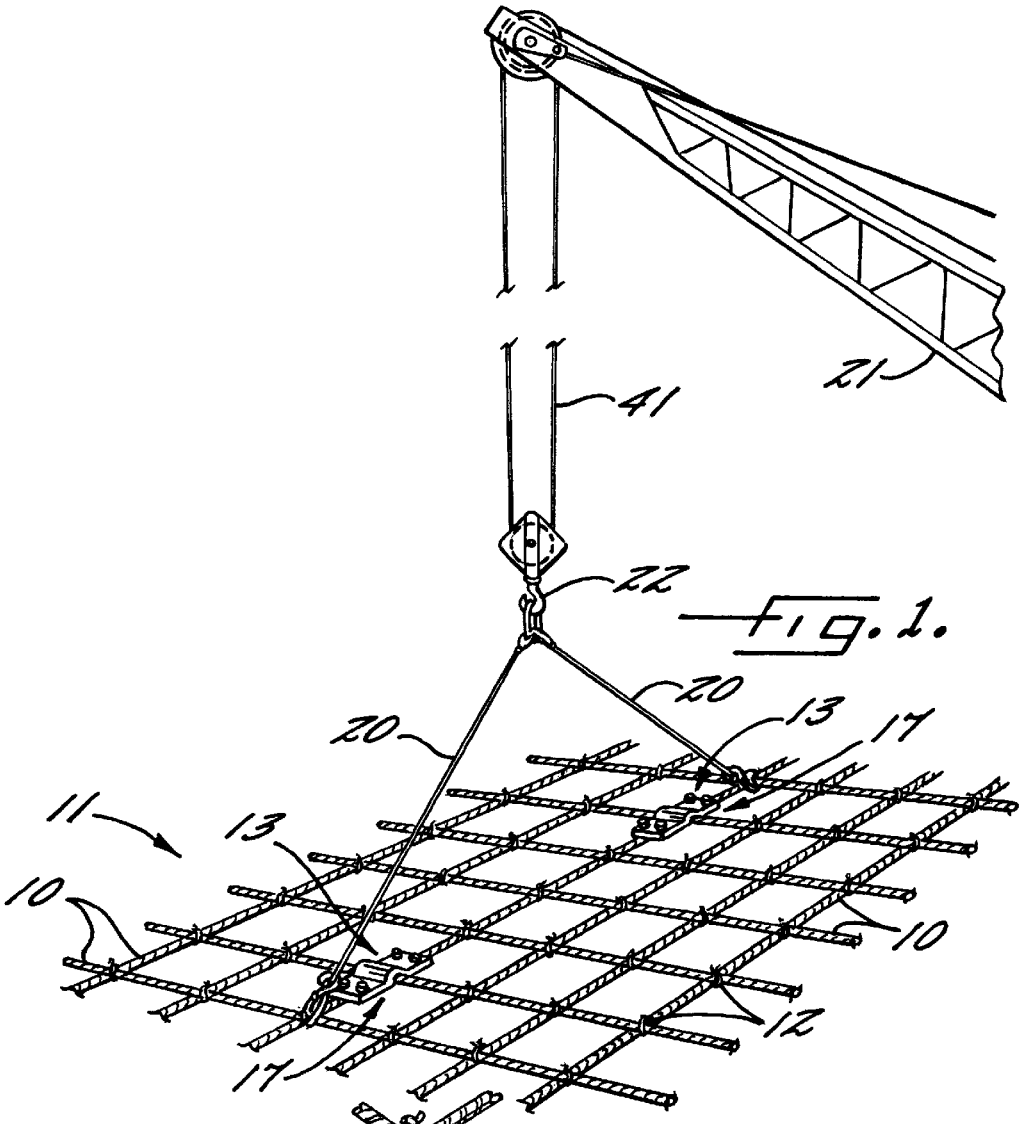
FIG. 1 is an environmental perspective view of an assembly site for assembling reinforcing bar into formwork and illustrating the intersections of the reinforcing bar fixed by the present clamp as the formwork is lifted by a crane using a hook and cable apparatus.
Figure 2:
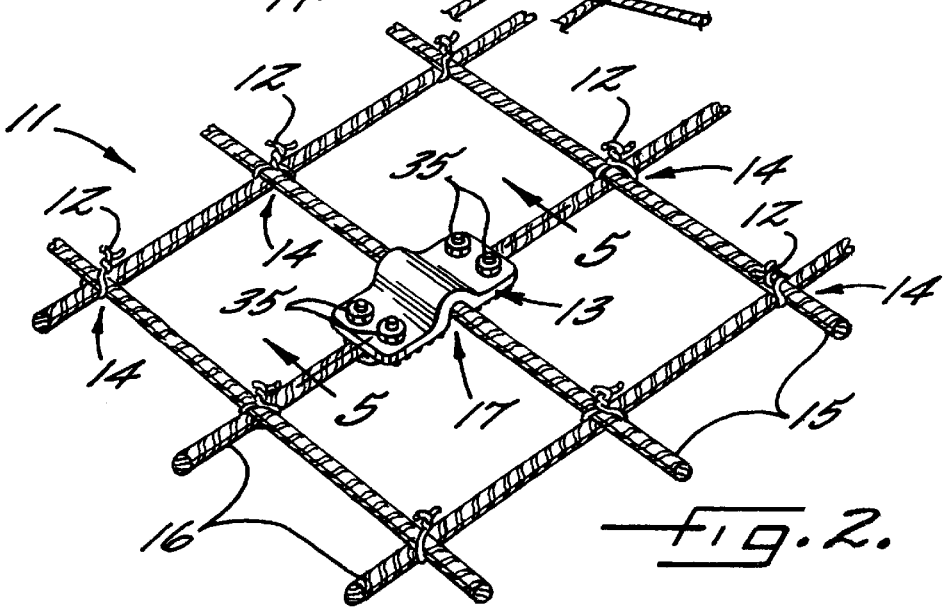
FIG. 2 is an enlarged perspective view of the present clamp illustrating the position of the clamp at the intersections of the reinforcing bar other that at the intersections secured by wire pieces.

Turning first to FIGS. 1 and 2, there is shown an assembly site depicting the reinforcing bar 10 fixed into formwork 11 of a desired assembly by clamps 13 and, optionally, by wire pieces 12 that secure the reinforcing bars to one another in an overlying fashion at select intersections created by the two reinforcing bars. In the preferred embodiment, the wire pieces 12 initially bind select intersections 14 into the particular configuration desired before affixing the clamps 13. Alternatively, the clamps 13 may be the sole means for fixing the reinforcing bar into the desired assembly of formwork. The wire pieces 12 and clamps 13 fix the reinforcing bars transverse or perpendicular to one another; however, the wire pieces and clamps may secure overlying reinforcing bars 15 to underlying reinforcing bars 16 at any desired angle to include acute, right, or obtuse angles. In a preferred embodiment, the worker fixes the clamp 13 to a sufficient number of intersections 17 necessary, according to the size and shape of the formwork, to maintain the formwork 11 in its preferred shape when lifted. Referring to FIG. 1, cables 20 secured to a lifting device 21 (e.g., crane) by means of a hook 22 are attached to portions of the formwork 11. It will be understood that any number of lifting devices can be used to lift the formwork. Further, a variety of securing means such as cables or ropes may be used to attach the formwork 11 to a lifting device. In an alternative embodiment, the hook 22 may directly clasp a portion of the formwork 11. The cables 20 illustrated in FIG. 1 are preferably attached to portions of the formwork 11 in close proximity to the intersections 17 reinforced by the clamps 13. Thus in the present embodiment, the cables 20 attach to portions of the reinforcing bar formwork 11 adjacent the clamps 13. Nevertheless, the cables 20 may be secured to any portion or portions of the formwork 11 so long as the cable arrangement prevents the particular assembly from disassembling or bending when the formwork is lifted. Stated differently, the cables 20 are preferably secured to portions of the formwork 11 that can sustain the loadbearing forces when the crane 21 lifts the formwork.

As depicted in FIG. 2, the clamps 13 secure the overlying reinforcing bar 15 at select intersections 17 that have not been secured by the wire pieces 12. Accordingly, the flexible wire pieces 12 allow the worker to quickly fix the reinforcing bar into formwork in a desired configuration and thereafter reinforce a select number of intersections 17 with the clamps 13. This is accomplished in the present instance by twisting the wire pieces 12 around any number of intersections of the reinforcing bar in order to stabilize the assembly in preparation for reinforcing any number of remaining intersections not fixed by the wire pieces 12 with the clamps 13. In this fashion, the present invention eliminates the cutting and welding of reinforcing bar into a desired assembly.

Figure 3:
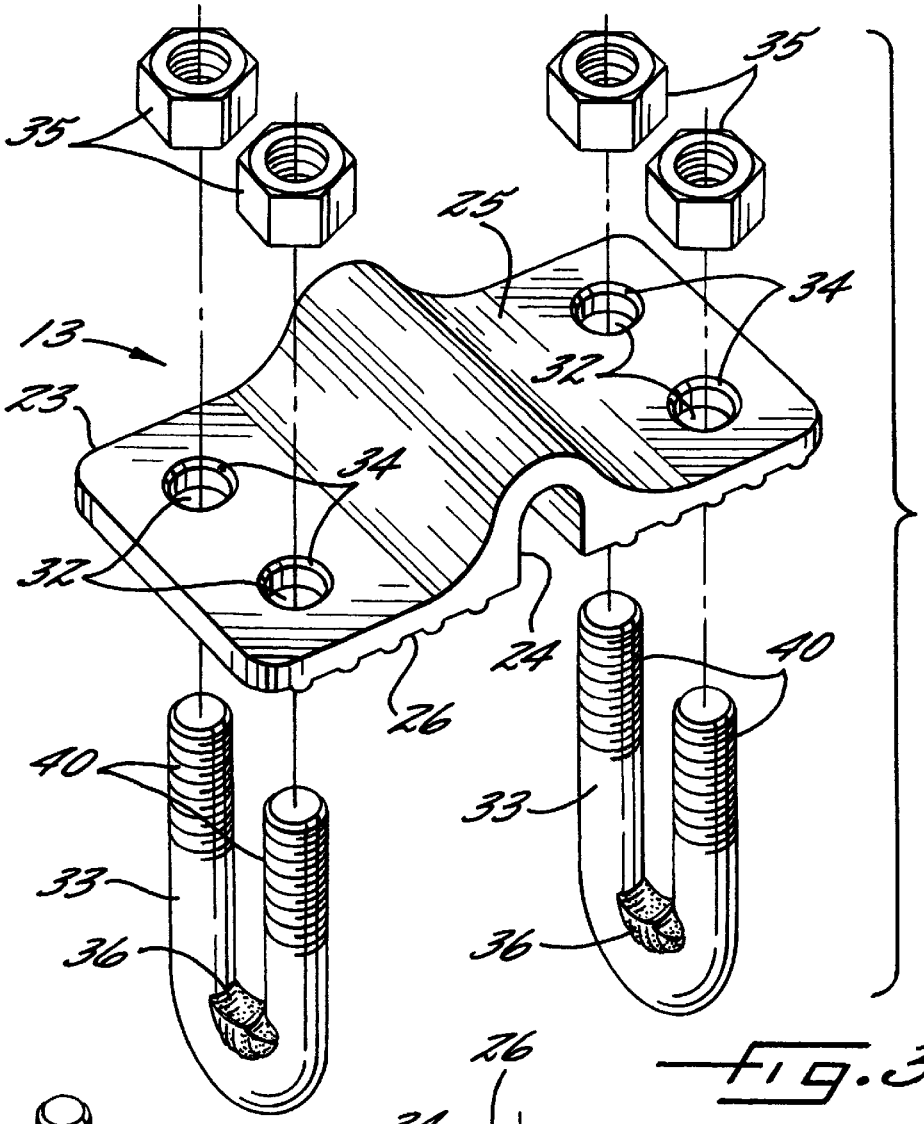
FIG. 3 is an exploded perspective view of the present clamp depicting the plate, channel, U-shaped members, and nuts.
Figure 4:
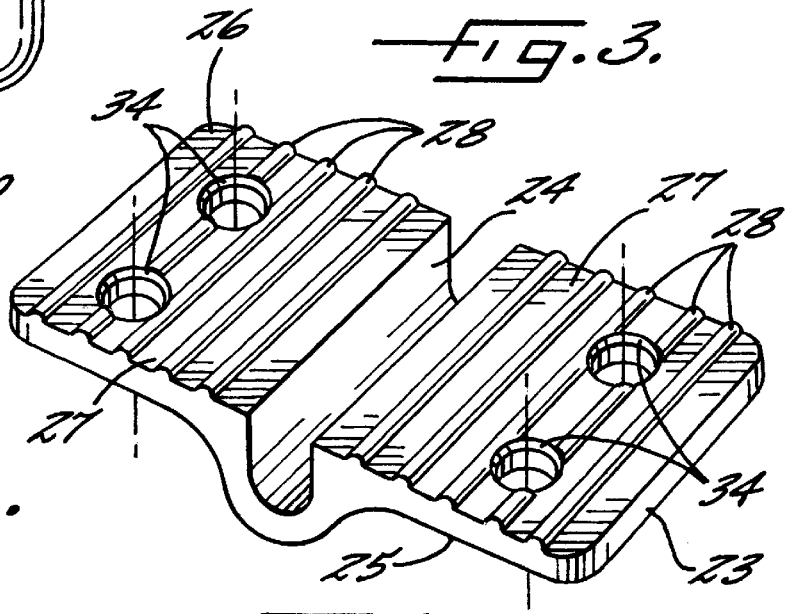
FIG. 4 is a perspective view of the present clamp illustrating the ridges forming the gripping surface on one face of the plate.

Turning to FIGS. 3 and 4, the various components of the clamp 13 include a plate 23 that is generally rectangular in shape and includes a recessed channel 24 extending the width of the plate. The channel 24 cradles and aligns a reinforcing bar placed therein. The preferred embodiment of the plate depicted in FIGS. 3 and 4 is generally rectangular in shape; however, it will be understood that the plate 23 may also be in the shape of a triangle, circle, square, or star, such that the configuration of the plate includes a recessed channel for securing the reinforcing bars at their intersections in an overlying fashion. As shown in FIG. 3, the plate has two opposing faces 25, 26. The first face 25 has a generally smooth surface and the second face 26 includes a gripping surface 27 defined, in the preferred embodiment, by a plurality of spaced apart ridges 28 that extend the width of the second face 26. The ridges 28 are spaced at intervals for the purpose of engaging the corresponding troughs 30 defined by the longitudinal ribs 31 extending the length of reinforcing bars 15, 16. Furthermore, the engaged ridges 28 and troughs 30 prevent the reinforcing bar from moving with respect to the second face 26. This particular feature of the present invention ensures that the individual pieces of overlying reinforcing bar do not slip or shift with respect to one another at the intersections fixed by the clamps 13 when the formwork is lifted, thereby preventing deformation of the formwork and potential injury to those in the path of falling debris. See FIG. 5. Alternatively, the gripping surface 27 may also include a resilient material of sufficient strength to engage the threaded exterior surface of the reinforcing bar. The resilient material may include plastic, rubber, or similar material for preventing slippage.

In the preferred embodiment, the recessed channel 24 has a generally round cross-section; however, it will be understood that the channel may be designed to conform to a variety of reinforcing bars of various shapes to include a rectangle, a triangle, or an oval. As depicted in the drawings, the recessed channel 24 extends co-directionally with the first face 25 of the plate 23, thereby forming a plate having a humpback appearance. Nevertheless, the present invention encompasses alternative embodiments to include plates of an increased thickness having a recessed channel that only extends through a portion of the plate 23. In other words, the recessed channel may not necessarily extend beyond the plane of the first face 25. In the alternative embodiment, the plate 23 lacks the humpback appearance because the thickness of the plate is greater than the depth of the channel 24.

The preferred embodiment of the clamp 13 depicted in FIG. 3 also includes two pairs of two holes 32 (i.e., four holes total) positioned on opposite sides of the recessed channel 24 that extend entirely through the plate. The holes 32 permit U-shaped members 33 to releasably secure a first reinforcing bar cradled in the recessed channel 24 between a second reinforcing bar held by the U-shaped members and the plate 23. Thus, when the clamp 13 fixes two reinforcing bars 15, 16 at an intersection 17, the U-shaped members 33 advance into the holes 32, thereby clamping the reinforcing bar positioned in the recessed channel 24 between the other reinforcing bar and the plate. Although the preferred embodiment includes two pairs of two holes 32 for receiving the U-shaped members 33, the plate 23 may include any number of holes depending upon the shape of the member used to secure the intersection of reinforcing bars (discussed in detail below) and the weight of the formwork to be lifted. For example, typical reinforcing bar used to construct a standard building wall is approximately ⅝ to ⅞ inches in diameter. Structures exposed to greater stress than standard building walls (e.g., dams) may require from 1⅛ up to 1¼-inch reinforcing bar. Accordingly, an alternative embodiment of the present invention may include multiple pairs of holes on opposite sides of the recessed channel 24 (e.g., four pairs of two holes or eight holes total) for supporting up to four U-shaped members 33. Openings 34 to the holes 32 may be chamfered so that the outer surfaces of the U-shaped members 33 are not damaged or worn away when the shaped members advance into the holes 32 to secure the clamp 13 to the intersecting reinforcing bars.

In the particular clamp 13 illustrated, the U-shaped members 33 support at least a portion of a reinforcing bar and thereby distribute the weight of the reinforcing bars to areas other than at the intersection when the formwork 11 is lifted. Advantageously, this configuration relieves the intersection of the two reinforcing bars of some of the weight directed to the point of contact between the two bars when the formwork 11 is lifted. In other words, absent the clamp 13, the load-bearing forces would be directed to the contact points of the two bars secured by the traditional wire pieces 12. The wire pieces tend to break under such stresses during the lifting of the formwork.

The gripping positions embodied by the U-shaped members 33 in the present instance may be provided by a variety of shaped members for securing the reinforcing bar against the plate 23. For example, the members may be T-shaped or L-shaped; however, it is important that the T-and L-shaped members be oriented properly with relation to the reinforcing bars and plate 23. If it is desired to obtain the benefits of a T- or L-shaped member (e.g., one-piece member) special considerations come into play because of the directional nature of both the T- and L-shaped members and the holes. Accordingly, the present invention further includes an attachment means configured to always align the base portion of the L-shaped member and the top portion of the T-shaped member to extend transverse to the reinforcing bar. The attachment means thus ensures that the full benefits of the T- or L-shaped member and plate can always be realized. In these alternative embodiments, the attachment means may comprise threaded male and female members with corresponding stops and helical threads which, when fully tightened, will cause the base portion of the L-shaped member and the top portion of the T-shaped member to extend in the proper direction such that the respective members clamp the reinforcing bar against the plate.

Figure 3A:
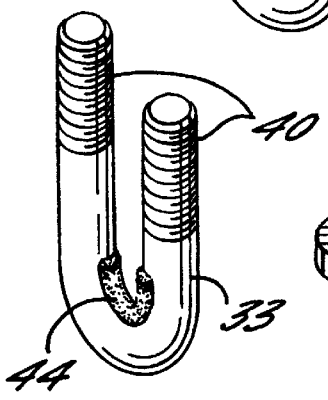
Figure 5:
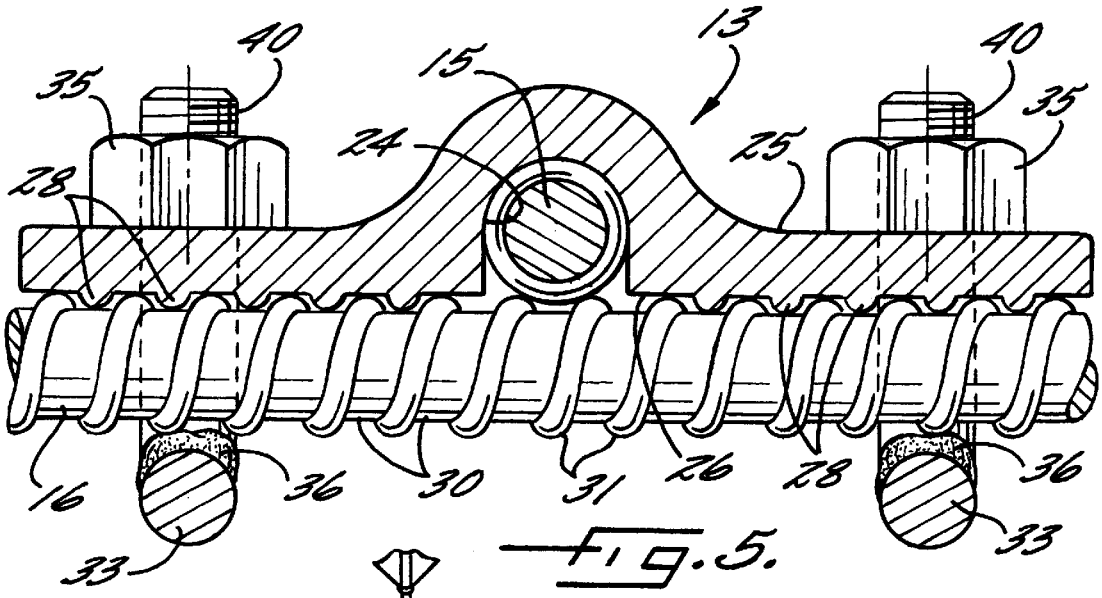
FIG. 5 is a partial cross-sectional view taken along lines 5—5 FIG. 1 depicting the relationship of the reinforcing bar to the ridges on one face of the plate and a metal bead on an interior portion of the U-portion of the U-shaped member.

In the preferred embodiment, the U-shaped members 33 include an attachment means for reinforcing the intersecting reinforcing bars. The attachment means include internally threaded nuts 35 that engage corresponding threads 40 on the outer surfaces of the U-shaped members 33. The U-shaped members 33 and associated attachment means removably secure the intersecting reinforcing bars against the plate 23 in an abutting fashion. As illustrated in FIGS. 3, 3A, and 5, the interior portions of the U-shaped members 33 may include a bead of metal 36 or raised lip 44 that provide resistance to wear on the surface of the U-portion of the U-shaped members in contact with the reinforcing bar.

In operation, the reinforcing bars 10 are placed on a flat surface and arranged into a desired assembly of formwork 11. A select number of intersections 14 of the reinforcing bar are optionally tied with flexible wire pieces 12. Clamps 13 are then fixed to a select number of intersections 17 (e.g., intersections not coupled by the flexible wire pieces). The clamp 13 is fixed to an intersection 17 such that the reinforcing bar situated in the channel 24 is secured between the other reinforcing bar held by the U-shaped members 33 and the plate. In other words, the U-shaped members 33 hold one reinforcing bar at their respective U-portions and will also hold the reinforcing bar in the channel.

The present invention also provides for a method for constructing reinforcing bar into formwork that includes assembling the reinforcing bar into a desired assembly in such a manner as to prevent the assembly from coming apart when the formwork is lifted and transported from the assembly site to the construction site for incorporation into a building. In the preferred construction, the method of constructing formwork for use in concrete construction includes assembling the reinforcing bar 10 into formwork 11 by arranging a first series of reinforcing bar 15 transverse to and in overlying relationship with a second series of reinforcing bar 16. In the illustrated embodiment, (see FIG. 2) the first 15 and second series 16 of reinforcing bar are positioned perpendicular to one another; however, it will be understood that the reinforcing bars may be placed at any desired angle depending upon the intended use or shape of the formwork. Next, wire pieces 12 are optionally tied around select intersections 14 of the reinforcing bar in order to secure the basic configuration of the formwork 11. Subsequently, clamps 13 are attached to a selected number of intersections 17 so that the formwork 11 is stabilized and reinforced for the eventual transportation of the formwork from the assembly site to the construction site.

Figure 6:
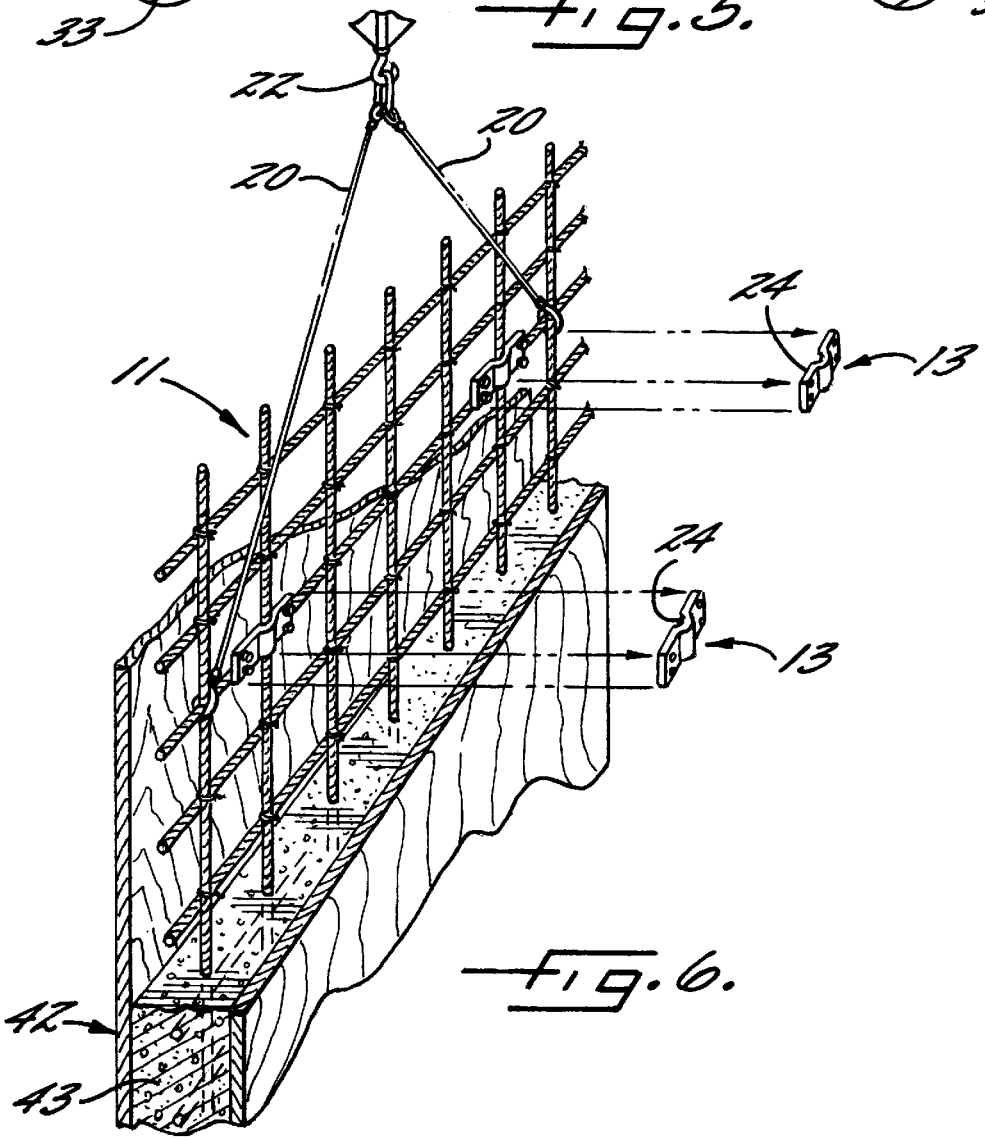
FIG. 6 is an environmental perspective view depicting the lifted reinforcing bar being placed a partially completed encasement form defining a wall section and the removal of the clamps for reuse.

Preferably, the first and second series of reinforcing bar 15, 16 are arranged on a flat surface (e.g., ground) and the bars are optionally set in the desired arrangement by twisting a flexible wire piece 12 around selected intersections 14 of the reinforcing bar. In an alternative embodiment, the intersections may be set by securing a cable tie (not shown) around the selected intersections. It will be understood that the wire pieces 12 or cable ties are optional. The formwork is then reinforced by securing the overlying reinforcing bars together at select intersections with a suitable number of clamps 13. It will be further understood that the number of intersections secured by the clamps 13 depends upon the size and weight of the assembled formwork. As depicted in FIG. 6, the channel 24 of the clamp 13 is oriented vertically with respect to the ground. It will be understood that the channel 24 may be oriented horizontally with respect to the ground without departing from the scope of the present invention. Stated differently, the lengthwise portion of the clamp 13 may either be oriented horizontally or vertically with respect the ground. After fixing the formwork 11 with clamps 13, the worker connects the cable 20 to the formwork in preparation for lifting the secured formwork to a desired height. In the preferred embodiment illustrated in FIGS. 2 and 6, the cables 20 are attached at two points of the formwork in close proximity to the clamps 13. In this fashion, when the crane 21 lifts the formwork 11, the cables 20 translate stress to the portions of the formwork reinforced by the clamps 13. Nevertheless, the point of attachment for the cables 20 depends upon the size and weight of the formwork. In the preferred embodiment, the hook 22 secured to one end of the crane's cable-lifting mechanism 41 clasps the cables 20 attached to portions of the formwork 11 and the crane 21 lifts the formwork to a desired height where it is secured in the lifted position. Next, the crane 21 moves the lifted formwork 11 from the assembly site to a construction site where the formwork is attached to a building under construction or repair. Prior to incorporating the formwork 11 into the building, a worker orients the formwork with respect to the building so that the formwork can be secured to the structure at a desired location and orientation. Stated differently, a worker aligns the formwork 11 with, for example, a floor or wall foundation under construction.

In the present instance illustrated in FIG. 6, the cables 20 attach to points adjacent the sides of the formwork 11; thus, the formwork is aligned vertically with respect to the ground when the crane 21 lifts the formwork. The vertical orientation of the formwork is suitable for securing the formwork 11 to, for example, a side of the building under construction. As is customary in concrete construction, an encasement form 42 is constructed of steel rails, cross members, and panels of sufficient strength to contain wet concrete 43 poured therein to form the steel-reinforced concrete wall. The formwork 11 can be properly aligned with the side of the building where a wall is to be formed by attaching an additional cable or rope (not shown) to a portion of the formwork 11 that can be manipulated by a construction worker standing near the construction site. Accordingly, the construction worker can guide and align the formwork 11 vertical orientation in this instance-so that the formwork can be secured to the building under construction. Next, the forming system (i.e., steel rails and cross members) is constructed thereby enclosing the secured formwork 11 within the encasement form 42. Typically, one side of the encasement form 42 is constructed by attaching steel rails and crossbars to existing portions of a wall under construction. Next, a mat or section of formwork 11 is secured to the existing structure at a position adjacent to the encasement form 42, the clamps 13 are removed from the intersections 17 for reuse, and the cables 20 are removed from the formwork. The encasement form 42 is then completed by constructing the remaining walls and securing panels thereto. Finally, wet concrete 43 is poured into the encasement form 42 and upon drying, the panels and encasement form are removed. The method described above may be repeated for any number of desired formwork.

In accordance with a further aspect of the invention, the clamps 13 can be used a repeated number of times in the method described above. Further, the clamps 13 eliminate the welding step (i.e., welding the intersections of the reinforcing bar together) relied upon in traditional construction methods. Advantageously, the clamps 13 are structurally suited to provide a more secure means of sustaining the stress placed upon the intersections, as compared to the wire pieces 12, when the formwork 11 is lifted. Additionally, the wire pieces 12 are limited to a one-time use.

From the foregoing, it will be seen that there has been brought to the art a new device which overcomes the drawbacks of assembling and transporting formwork in a desired assembly on maintaining the structural integrity of formwork. Further it will be seen that the method disclosed above overcomes the drawbacks of cutting and welding links of reinforcing bar together into formwork, namely the extended period of time required to weld the reinforcing bars together. A particular advantage of the present invention is the construction worker's ability to rapidly assemble and secure formwork 11 into a desired configuration with the clamps 13 which maintain the structural integrity of the formwork during transportation from the assembly site to the construction site. Further, the gripping positions embodied by the U-shaped members 33 on respective opposite sides of the intersection of the two reinforcing bars distributes the weight of the bars to areas other than at the intersection. In other words, the U-shaped members 33 positioned on the extended portions of the plate 23 on both sides of the recessed channel 24 distribute the weight to the surface area provided by the opposed faces of the plate, thereby decreasing the likelihood of bending or breaking the reinforcing bar that would otherwise bear the weight of the formwork when lifted. An additional advantageous aspect of the invention is the spaced-apart ridges 28 on one face of the plate 23 that engage the corresponding troughs 30 on the threaded outer surface of the reinforcing bar, thereby ensuring the secure engagement of the plate to the reinforcing bar and preventing slippage between the intersecting reinforcing bar.

In the drawings and specification, there have been disclosed typical embodiments on the invention and, although specific terms have been employed, they have been used in a generic and descriptive sense only and not for purposes of limitation, the scope of the invention being set forth in the following claims.

That which is claimed is:

1. A device for fixing formwork having at least a first reinforcing bar and a second reinforcing bar in a desired assembly and for maintaining the formwork in the desired assembly as the assembly is lifted, said device comprising:

a plate for fixing the first and the second reinforcing bars at an angle to one another such that the two bars overly and intersect one another, said plate having opposing first and second faces, and a plurality of holes that extend entirely through said plate;

a channel defined by said plate for positioning the first reinforcing bar against said plate;

U-shaped members having legs for securing the second reinforcing bar against said second face of said plate, said legs positioned in each hole such that said U-shaped members are parallel to each other for receiving the second reinforcing bar secured there through; and means for fastening said U-shaped members to said plate such that said U-shaped members secure the second reinforcing bar against said second face of said plate, said fastening means positioned adjacent said first face for engaging said legs of said U-shaped members that extend through said holes in said plate;

wherein said plate includes at least two gripping positions on respective opposite sides of said channel, said gripping positions capable of bearing weight of the first and the second reinforcing bars other than at an intersection;

wherein said second face includes a plurality of ridges extending along a width of said plate for engaging the second reinforcing bar and preventing movement of the second reinforcing bar relative to said plate.

2. A device according to claim 1 wherein said holes include chamfered openings on said first face and said second face of said plate for preventing damage to outer surfaces of said U-shaped members.

3. A device according to claim 1 wherein interior surfaces of said U-shaped members include a bead of metal of sufficient hardness to resist wear caused by contact with the second reinforcing bar supported by said members.

4. A device according to claim 1 wherein said fastening means includes two nuts for engaging respective legs of each of said U-shaped members and for tightening a second reinforcing bar supported by said U-shaped members against said second face of said plate.

5. A device for fixing formwork having at least a first reinforcing bar and a second reinforcing bar in a desired assembly and for maintaining the formwork in the desired assembly as the assembly is transported, said device comprising:

a plate for aligning an intersection of the first and the second reinforcing bars, said plate having opposing first and second faces of a predetermined width and length, said second face including a plurality of spaced apart ridges extending along the width of said second face;

means for fixing the first reinforcing bar to said plate; and means for fixing the second reinforcing bar between the first reinforcing bar and said plate when the first reinforcing bar is fixed to said plate;

wherein said plurality of spaced apart ridges are capable of engaging the first reinforcing bar and thereby preventing the first reinforcing bar from moving with respect to said plate when the formwork is transported;

wherein said means for fixing the second reinforcing bar between the first reinforcing bar and said plate comprises a recessed channel extending the width of said plate for receiving at least a portion of the second reinforcing bar that forms an intersection with the first reinforcing bar.

6. A device according to claim 5 wherein said means for fixing the first reinforcing bar to said plate comprises:

a plurality of U-shaped members having legs for supporting at least a portion of a first reinforcing bar, such that a first reinforcing bar abuts a second reinforcing bar at an intersection;

a pair of spaced apart holes extending through said plate, said holes defined by openings on said first and second faces for receiving said legs of said plurality of U-shaped members; and attachment means associated with each U-shaped member for removably securing said plate to said intersection of the first and the second reinforcing bars when said legs advances respectively into said holes.

7. A device according to claim 6 wherein said attachment means comprises nuts for engaging corresponding threads on exterior surfaces of each leg of said plurality of U-shaped members.

8. A device according to claim 6 wherein said openings are chamfered for preventing damage to the exterior surfaces of said legs of said plurality of U-shaped members when said plate is releasably secured to the intersection of the first and the second reinforcing bars by at least one of said U-shaped members.

9. A device according to claim 6 wherein portions of said plurality of U-shaped members include a means for engaging exterior surfaces of a first reinforcing bar, thereby restricting the movement of the first reinforcing with respect to said plurality of U-shaped members when the formwork is lifted.

10. A device according to claim 9 wherein said engaging means includes a raised lip for preventing movement of the first reinforcing bar with respect to said plurality of U-shaped members.

11. A device according to claim 6 wherein said plurality of said U-shaped members include a means for preventing wear on interior portions of said U-shaped members when in contact with the first reinforcing bar.

12. A device according to claim 11 wherein said preventing means includes a bead of metal.

13. A device for fixing reinforcing bar formwork in a desired assembly and for maintaining the formwork in the desired assembly as the assembly is lifted, said device comprising:

a plate;

two clamps on said plate for clamping a first reinforcing bar against said plate, said clamps laterally spaced from one another, and parallel to each other; and a longitudinal channel in said plate positioned between said clamps such that when a second reinforcing bar is positioned in said channel and the first reinforcing bar is positioned in said clamps, said clamps are capable of securing the first reinforcing bar, and said clamps are capable of securing the first reinforcing bar against the second reinforcing bar in said channel;

wherein portions of said clamps include a bead of metal for engaging the first reinforcing bar.

14. A device according to claim 13 wherein said plate is rectangular, triangular, or oval in shape.

15. A device according to claim 13 wherein said plate includes a pair of two openings for receiving said clamps, each of said openings extending entirely through said plate and positioned on respective opposite sides of said channel.

16. A device according to claim 15 wherein said clamps are U-shaped.

17. A device according to claim 13 wherein:

said plate includes two openings extending entirely through said plate for receiving said clamps, said openings positioned on respective opposite sides of said channel;

wherein said clamps are T-shaped or L-shaped.

18. A device according to claim 13 wherein:

said plate includes two openings extending through a portion of said plate for receiving said clamps, with said openings positioned on respective opposite sides of said channel;

wherein said clamps are T-shaped or L-shaped.

19. A device for fixing reinforcing bar formwork into desired assembly and for maintaining the formwork in the desired assembly as the assembly is lifted, said device comprising:

a plate with a channel therein, said channel having a generally U-shaped cross section and extending co-directionally with one face of said plate, said plate including two pairs of two openings that extend entirely through said plate;

a pair of U-bolts having legs positioned respectively in each of said openings, said U-bolts extending from a face of said plate opposite the one face with which said channel extends; and nuts associated with each leg of said U-bolts for tightening a reinforcing bar that is supported by said U-bolts and that is positioned against the one face;

wherein interior portions of said U-bolts include a bead of metal for engaging the first reinforcing bar.

20. A clamp for assembling at least two reinforcing bars into formwork used in concrete construction and stabilizing the formwork when the assembly is transported, said clamp comprising:

a plate for securing the at least two intersecting reinforcing bars and for distributing the weight of the at least two reinforcing bars other than at an intersection, said plate having opposing faces and a recessed channel for cradling a first reinforcing bar of the at least two bars;

a plurality of U-shaped members for releasably securing the first reinforcing bar between a second reinforcing bar of the at least two bars and said plate, said U-shaped members having elongated end portions;

a pair of spaced apart holes at positions on respective opposite sides of said recessed channel, said holes extending through said plate for receiving elongated end portions of said U-shaped members; and an attachment means associated with each of said U-shaped members for removably securing the second reinforcing bar adjacent said plate such that said plurality of U-shaped members fix the second reinforcing bar transverse to and in overlying relationship with the first reinforcing bar when said respective end portions of said U-shaped members advance into said holes;

wherein one face of said plate includes a plurality of spaced apart ridges extending along a width of said plate for engaging the second reinforcing bar and stabilizing the formwork when the formwork is transported.

21. A clamp according to claim 20 wherein said attachment means comprises internally threaded nuts for engaging corresponding threads on an outer surface of each of said respective end portions of said U-shaped members.

22. A clamp according to claim 20 wherein said openings are chamfered for preventing damage to outer surfaces of said elongated end portions of said U-shaped members when said U-shaped members secure a first reinforcing bar between a second reinforcing bar and said plate.

23. A clamp according to claim 20 wherein interior portions of said plurality of U-shaped members include a means for gripping exterior surfaces of the second reinforcing bar thereby preventing the second reinforcing bar from moving with respect to said U-shaped members when the formwork is transported.

24. A clamp according to claim 23 wherein said gripping means includes a bead of metal.

25. A grid assembly for use in constructing reinforced concrete structures, said grid comprising:

a first series of reinforcing bars positioned transverse to and in overlying relationship with a second series of reinforcing bars, such that said first and said second series of reinforcing bars form a plurality of intersections of reinforcing bars;

a plate for fixing at least one of said plurality of intersections such that at least one reinforcing bar of said first series is fixed at an angle to at least one reinforcing bar of said second series, said plate having opposing first and second faces, a plurality of holes that extend entirely through said plate, and at least two gripping positions being on respective opposite sides of at least one of said intersections;

a channel defined by said plate for positioning the at least one reinforcing bar of said first series against said plate;

U-shaped members having legs for securing the at least one reinforcing bar of said second series that intersects said reinforcing bar in said channel against said second face, said legs positioned in each hole such that said U-shaped members are parallel to each other for receiving said at least one reinforcing bar of said second series secured there through; and means for fastening said at least one reinforcing bar of said second series against said second face, said fastening means positioned adjacent said first face for engaging the legs of said U-shaped members that extend through said holes in said plate;

wherein said second face includes a plurality of ridges for engaging said at least one reinforcing bar of said second series and preventing movement of said at least one reinforcing bar of said second series relative to said plate.

26. The grid assembly according to claim 25, wherein said holes include chamfered openings on each of the faces of said plate for preventing damage to outer surfaces of said U-shaped members.

27. The grid assembly according to claim 25, wherein interior surfaces of said U-shaped members include a means for resisting wear to interior surfaces in contact with said at least one reinforcing bar of said second series supported by said members.

28. The grid assembly according to claim 27 wherein said resisting means includes a bead of metal of sufficient hardness to prevent wear to said U-shaped members.

29. The grid assembly according to claim 25 wherein said fastening means includes two nuts for engaging respective legs of each U-shaped member and for tightening said at least one reinforcing bar of said second series against said plate.

* * * * *